US008899575B2

(12) United States Patent
Hakamata

(10) Patent No.: US 8,899,575 B2
(45) Date of Patent: Dec. 2, 2014

(54) SHEET FEEDING DEVICE AND RECORDING APPARATUS

(75) Inventor: Keisei Hakamata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 13/550,798

(22) Filed: Jul. 17, 2012

(65) Prior Publication Data

US 2013/0043643 A1 Feb. 21, 2013

(30) Foreign Application Priority Data

Aug. 18, 2011 (JP) ..... 2011-178796

(51) Int. Cl.

*B65H 3/52* (2006.01)
*B65H 3/56* (2006.01)
*B65H 3/06* (2006.01)

(52) U.S. Cl.

CPC ..... *B65H 3/0684* (2013.01); *B65H 3/56* (2013.01); *B65H 2511/22* (2013.01); *B65H 2405/1134* (2013.01); *B65H 2405/142* (2013.01); *B65H 2515/81* (2013.01); *B65H 2403/53* (2013.01); *B65H 2405/1136* (2013.01); *B65H 2402/344* (2013.01); *B65H 2301/4222* (2013.01)

USPC ..... 271/124; 271/121; 271/122; 271/167

(58) Field of Classification Search

USPC ..... 271/121, 122, 124, 167
See application file for complete search history.

(56) References Cited

U.S. PATENT DOCUMENTS 5,895,040 A * 4/1999 Oleksa et al. ..... 271/124
6,540,221 B2 * 4/2003 Nakashima et al. ..... 271/121
6,880,821 B2 * 4/2005 Park ..... 271/121
7,036,814 B2 * 5/2006 Oh et al. ..... 271/121
7,420,693 B2 * 9/2008 Kang et al. ..... 358/1.12
8,256,761 B1 * 9/2012 Klein ..... 271/121
8,517,375 B2 * 8/2013 Otani et al. ..... 271/167
2004/0026845 A1 * 2/2004 Park ..... 271/167
2004/0032077 A1 2/2004 Oh et al.
2007/0222139 A1 * 9/2007 Hotani ..... 271/121

FOREIGN PATENT DOCUMENTS

JP 2004-075394 A 3/2004
JP 2004075394 A 3/2004
JP 2008-239272 A 10/2008

OTHER PUBLICATIONS

Webster's New World Dictionary and Thesaurus, Copyright 1996, Simon & Schuster Inc, p. 361.*

* cited by examiner

*Primary Examiner* — Prasad Gokhale
(74) *Attorney, Agent, or Firm* — Fitzpatrick, Cella, Harper & Scinto

(57) ABSTRACT

There is disclosed a sheet feeding device which feeds a plurality of stacked sheet-like recording media one by one from a tray containing the recording media, including a sheet feeding roller which comes in contact with the uppermost layer of the recording media contained in the tray, and rotates to feed the recording medium; an inclined member including an inclined surface which is positioned on a downstream side in a feeding direction of the recording media, and inclined at an obtuse angle to the feeding direction of the recording media, and on which the fed recording media abuts; and a separating member having an uneven surface, to separate the one fed recording medium, wherein the separating member is configured to be movable between a position projecting to the inclined member and a position retreated from the projecting position, while maintaining the same inclining angle as that of the inclined member.

12 Claims, 11 Drawing Sheets

SHEET FEEDING DEVICE AND RECORDING APPARATUS

BACKGROUND OF THE INVENTION

1. Field of the Invention

The present invention relates to a sheet feeding device which separates and conveys stacked recording media one by one, and a recording apparatus on which the sheet feeding device is mounted.

2. Description of the Related Art

A recording apparatus such as a printer, a photocopying machine or a facsimile machine includes a sheet feeding device which stacks and contains a plurality of recording media in a sheet feeding tray, and separates and feeds the stacked and contained recording media one by one. As separation systems for the recording media in the sheet feeding device, many constitutions have been suggested, and as one of the constitutions, an inclined surface separation system is known where a front edge of each recording medium is made to abut on a separating member disposed on an inclined surface which is inclined to a traveling direction of the recording media, thereby separating the recording media. The sheet feeding device of the inclined surface separation system is disclosed in JP-A-2008-239272 and JP-A-2004-075394.

JP-A-2008-239272 discloses a sheet feeding device where a plurality of separation claw pieces are fixedly arranged along an inclined surface on which the recording media abut. In this sheet feeding device, to prevent the double-sheets feeding of the recording media, the separation claw pieces are formed so that an angle of each claw piece to the inclined surface on a downstream side (a vertex side of the inclined surface) in a traveling direction becomes smaller than on an upstream side (a foot side of the inclined surface) in the traveling direction.

Moreover, JP-A-2004-075394 discloses a sheet feeding device where a separating member having projections formed along an inclined surface is disposed. This separating member is movable along the inclined surface, a base end of the separating member on a bottom side of a sheet feeding tray is formed in a cantilever-like constitution, or the separating member turns around a portion of the separating member which is a turn center, so that a further improved separation performance is exerted, when each recording medium abuts on the inclined surface.

In a recording apparatus, there are used various types of recording media having different characteristics, for example, recording media called plain papers and having a low rigidity, recording media called photograph sheets and having a high rigidity, and the like. For example, since the plain papers have the low rigidity, it is difficult to separate the papers one by one, but since the photograph sheets have the high rigidity, the sheets can easily be separated one by one.

It is not easy to separate the recording media having the different characteristics one by one in this way by use of a common sheet feeding device of an inclined surface separation system. That is, a resistance required to separate the recording media in the inclined surface separation system (a relative relation between the required resistance and a limited resistance) varies for each type of the recording media. Therefore, it is not possible to set such a relation between the resistances as to enable the suitable separation of any recording media.

For example, in the separation device disclosed in JP-A-2004-075394, the separating member is movable. In the constitution where the member moves along the inclined surface, however, it is not possible to create such a difference of the frictions as to assure the separating operations of the recording media having the different characteristics. Moreover, in the constitution where the separating member turns around a portion of the member which is a supporting point, the resistances are different between an inclined state of the separating member in a case where an amount of the stacked recording media is small and an inclined state of the separating member in a case where the amount is large. In consequence, the relation between the resistances changes in accordance with a stack position, and even when the same type of recording media are separated, the media cannot suitably be separated.

Moreover, when the photograph sheets are used as the recording media, there is a possibility that an excessively large resistance is applied to a front edge of each photograph sheet that comes in contact with the separating member to peel off the coating surface of the photograph sheet, if the separating resistance is not suitably set. Furthermore, there is known a constitution where a U-turn-like path is employed as a conveyance path of the recording media for the purpose of making the recording apparatus smaller. For example, when the photograph sheets are used in this recording apparatus, the separating member abuts on a recording surface (the coating surface), and hence there is also a possibility that the coating surface is damaged, when an unsuitable resistance is applied.

SUMMARY OF THE INVENTION

The present invention relates to a sheet feeding device based on a constitution which separates a plurality of stacked recording media one by one, and a recording apparatus on which the sheet feeding device is mounted. More particularly, an object of the present invention is to provide a sheet feeding device including a constitution which can suitably separate and convey recording media one by one in accordance with characteristics of the recording media (especially, the rigidity of the recording media), irrespective of the characteristics of the recording media, and a recording apparatus on which the sheet feeding device is mounted.

The present invention has been developed by focusing on a viewpoint that it is possible to regulate a separating resistance in separating recording media, when a constitution is employed where a separating member which separates the recording media moves forwards and backwards along an inclined surface while maintaining the same inclining angle as in the inclination of the inclined surface for inclined-surface separation. That is, the present invention employs a constitution where when a recording medium having a low rigidity abuts on the separating member, the separating member essentially does not move backwards, but exerts a large separating resistance, and when a recording medium having a high rigidity abuts on the separating member, the separating member moves backwards, and the separating resistance becomes small. Additionally, in the constitution where the member moves forwards and backwards while maintaining the same inclining angle as that of the inclined surface, the separating resistance does not change in accordance with an amount of the stacked recording media, and a constant separating resistance is maintained from a state where the recording media are fully stacked to an empty state, which enables stable separation.

To achieve the above object, a sheet feeding device of the present invention is a sheet feeding device which feeds a plurality of stacked sheet-like recording media one by one from a tray containing the recording media, comprising: a sheet feeding roller which comes in contact with the uppermost layer of the recording media contained in the tray, and rotates to feed the recording medium; an inclined member including an inclined surface which is positioned on a downstream side in a feeding direction of the recording media, and inclined at an obtuse angle to the feeding direction of the recording media, and on which the fed recording medium abuts; and a separating member having an uneven surface, to separate the one fed recording medium, wherein the separating member is configured to be movable between a position projecting to the inclined member and a position retreated from the projecting position, while maintaining the same inclining angle as that of the inclined member.

To achieve the above object, a recording apparatus of the present invention comprises the sheet feeding device, and a recording head which records an image on a recording medium fed from the sheet feeding device.

According to the present invention, a plurality of recording media stacked on one another can suitably be separated one by one in accordance with characteristics of the recording media (especially the rigidity of the recording media), irrespective of the characteristics of the recording media, and regardless of an amount of the stacked recording media.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiment 1

Figure 1:
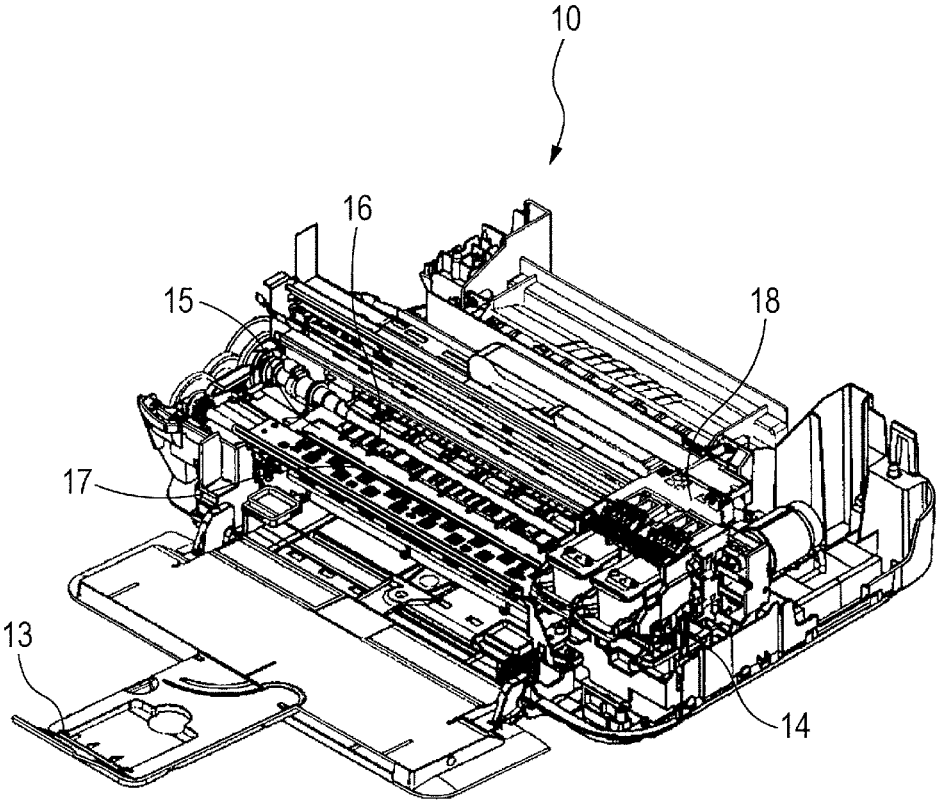
FIG. 1 is a perspective view showing an inner constitution of an ink jet recording apparatus which is an embodiment of a recording apparatus of the present invention.

FIG. 1 is a perspective view showing an inner constitution of an ink jet recording apparatus 10 which is an embodiment of a recording apparatus of the present invention. FIG. 1 mainly shows a constitution of an image forming section which records an image on each recording medium. The image forming section is constituted of a recording head 14, a platen 15, a pair of main conveying rollers 16, a sheet discharge roller 17, a carriage 18, and the like. In the ink jet recording apparatus 10 shown in FIG. 1, each recording medium fed from a sheet feeding device (not shown: description will be made later in detail) disposed in a bottom surface of the apparatus passes through a conveying path (not shown) positioned in a rear part of the recording apparatus and curved in a U-shape, and the medium is conveyed to the platen 15. Afterward, the recording head 14 discharges ink to record the image on the recording medium while scanning along the platen 15. At this time, the recording head 14 discharges the ink, when the carriage 18 moves in a direction which is perpendicular to a traveling direction of the recording medium. The recording medium on which the image is formed is discharged to a sheet discharge tray 13.

Figure 2:
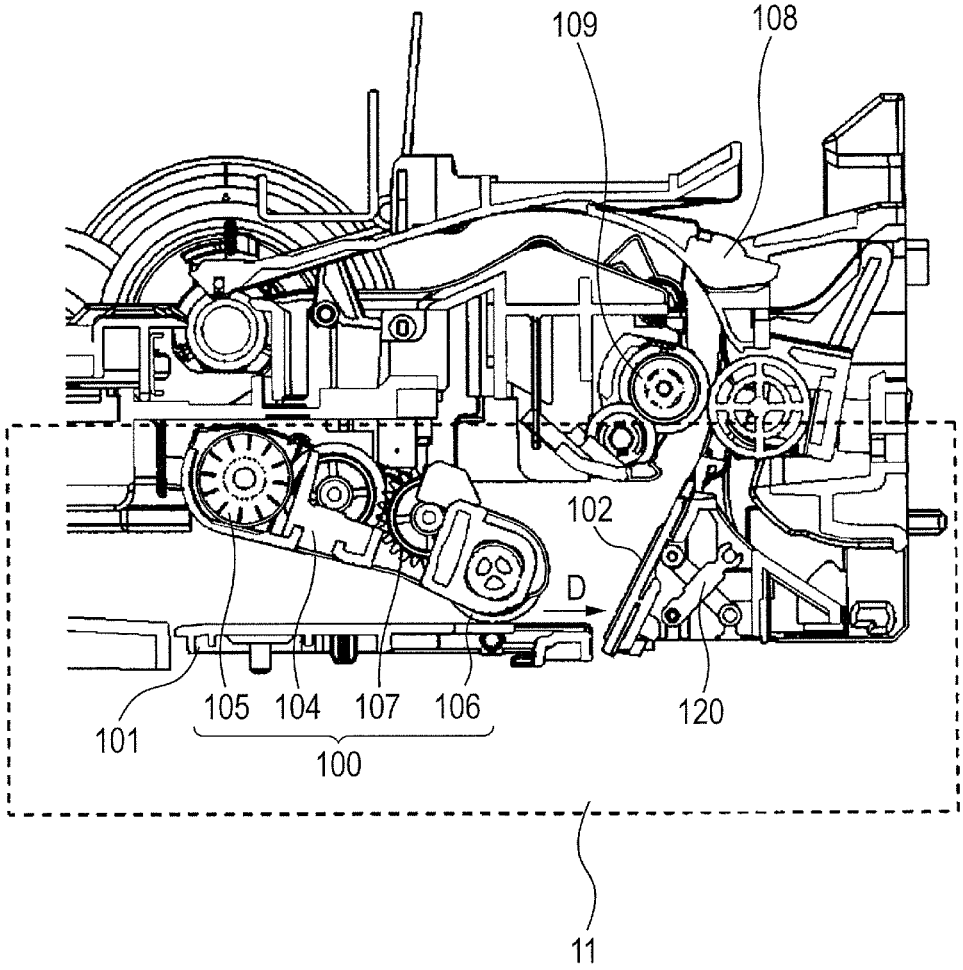
FIG. 2 is a sectional view showing a constitution of a sheet feeding device mounted on the recording apparatus shown in FIG. 1.

FIG. 2 is a sectional view showing a constitution of the sheet feeding device mounted on the recording apparatus shown in FIG. 1. A sheet feeding device 11 shown in FIG. 2 is provided with a sheet feeding tray 101 which can contain a plurality of recording media P stacked on one another. In the sheet feeding tray 101, side surfaces of the respective recording media P are aligned by a not-shown side surface guide. In front of the sheet feeding tray 101 in a traveling direction D of the recording media P, an inclined surface member 102 is disposed to separate the recording media P one by one. Above the sheet feeding tray 101, a sheet feeding mechanism 100 is disposed. The sheet feeding mechanism 100 includes a sheet feeding arm 104. The sheet feeding arm 104 rotates around a rotary shaft 105, and can accordingly rotate in accordance with a stacking height of the recording media P stacked in the sheet feeding tray 101. To a front end of the sheet feeding arm 104, a sheet feeding roller 106 which advances the recording medium P of the uppermost layer is attached. The sheet feeding roller 106 is driven by a power transmitted via the rotary shaft 105 and a sheet feeding idler gear 107. The sheet feeding roller 106 abuts on the recording medium P of the uppermost layer. When the sheet feeding roller 106 is driven, the recording medium P is fed in the traveling direction D by a frictional force between the sheet feeding roller 106 and the recording medium P. At this time, a plurality of recording media P (e.g., about two to five media) are fed. Afterward, when the recording media P pass through the inclined surface member 102, the recording media are separated one by one.

On a downstream side of the inclined surface member 102 in a conveying direction of the recording medium P, a U-shaped conveying guide member 108 is disposed. Between the inclined surface member 102 and the conveying guide member 108, a conveying roller 109 is disposed. The recording medium P separated by the inclined surface member 102 is conveyed by a conveying force of the sheet feeding roller 106, so that the medium meshes with the conveying roller 109. Afterward, the recording medium P is conveyed along the conveying guide member 108 to the platen 15.

Hereinafter, the inclined surface member 102 will be described in detail.

Figure 3:
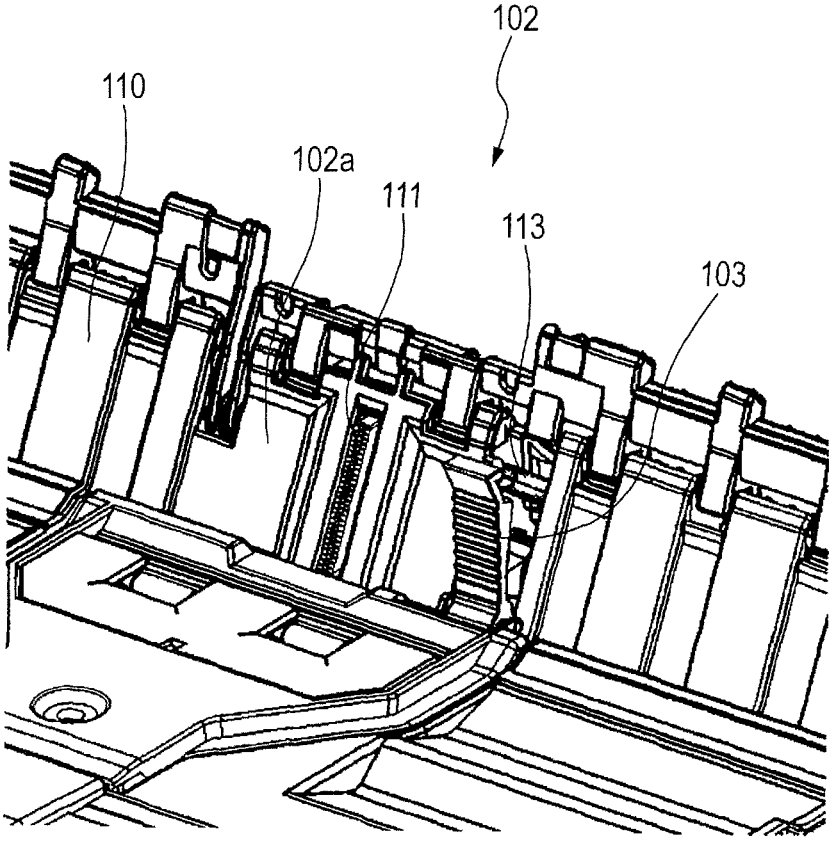
FIG. 3 is a perspective view of an inclined surface member disposed in the sheet feeding device shown in FIG. 2.
Figure 4:
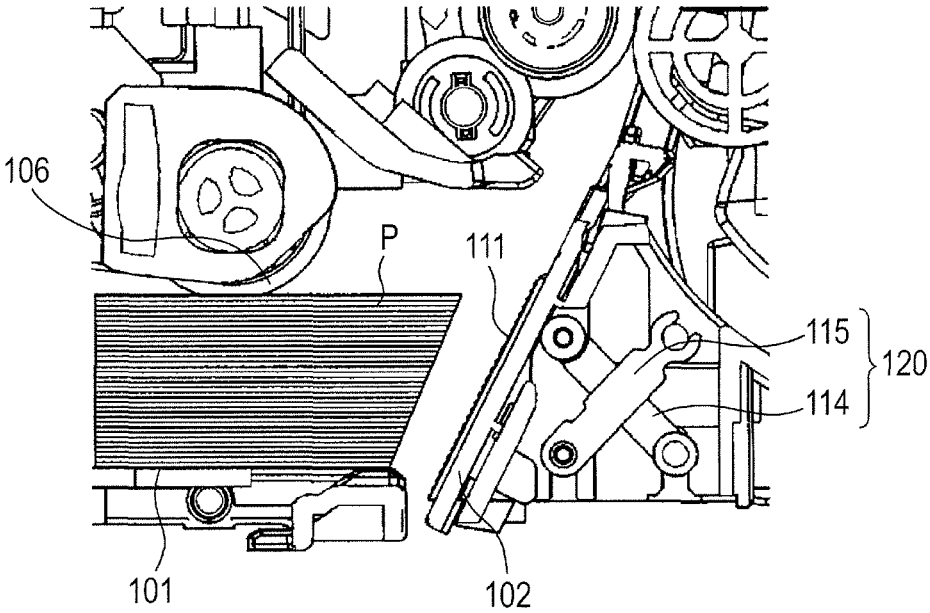
FIG. 4 is a sectional view of the inclined surface member shown in FIG. 3.

FIG. 3 is a perspective view of the inclined surface member 102 disposed in the sheet feeding device 11 shown in FIG. 2. FIG. 4 is a sectional view of the inclined surface member 102 shown in FIG. 3. The inclined surface member 102 has an inclined surface 102*a* (see FIG. 3) inclined at an obtuse angle to the traveling direction D, so as to easily separate the recording medium P of the uppermost layer. The inclined surface 102*a* is provided with an inclined surface guide member 110 to decrease a conveying resistance when conveying the recording medium P along the inclined surface 102*a*. The surface of the inclined surface guide member 110 which comes in contact with the recording medium P has a shape obtained by flatly processing a material having a small friction coefficient. In the inclined surface 102*a* of the inclined surface member 102, two openings are formed. An abutment member 103 projects through one of the openings, and a separating member 111 projects through the other opening. Hereinafter, the abutment member 103 and the separating member 111 will be described.

Figure 5A:
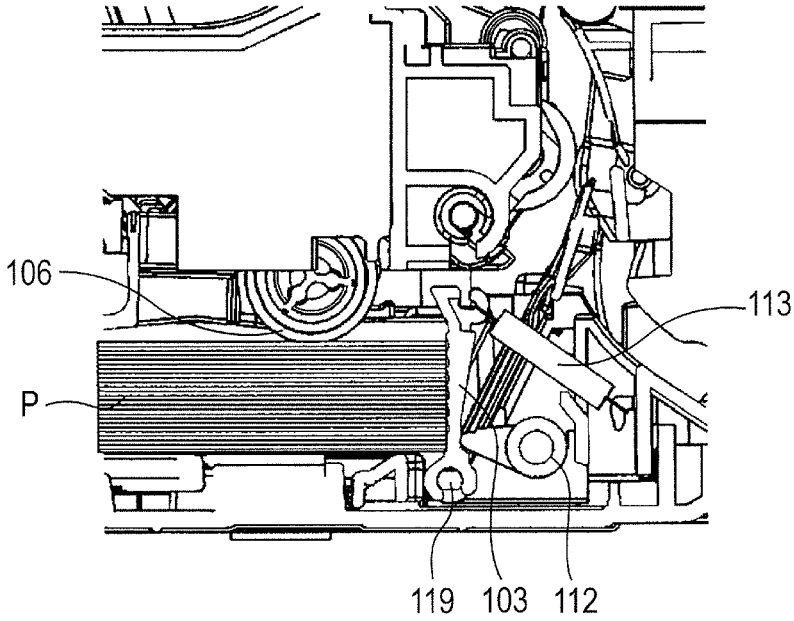
FIGS. 5A and 5B are sectional views of an abutment member 103 disposed in the sheet feeding device shown in FIG. 3.
Figure 5B:
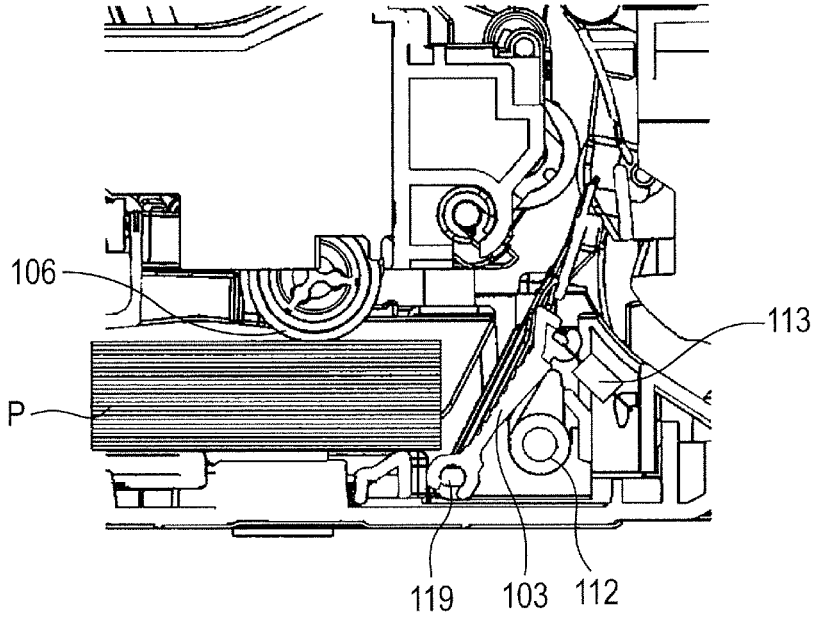

First, the abutment member 103 will be described. FIGS. 5A and 5B are sectional views of the abutment member 103 disposed in the sheet feeding device 11 shown in FIG. 3. FIG. 5A shows that the abutment member 103 is held at a position where the member abuts on a front edge of each recording medium P. FIG. 5B shows that the abutment member 103 is held at a position where the member is away from the front edge of the recording medium P and is retreated from the inclined surface guide member 110. The abutment member 103 is attached to a rotary shaft 119 disposed on the lower side (the foot side) of the inclined surface 102*a* of the inclined surface member 102. The surface of the abutment member 103 is formed in a step-like shape having a plurality of curved surfaces. Therefore, even when the abutment member 103 abuts on the respective recording media P with great force to align the front edges of the recording media P contained in the sheet feeding tray 101, damages on the recording media P can be decreased. The back surface of the abutment member 103 is pressed by a cam member 112. The cam member 112 is attached to a rotary shaft (not shown) disposed in the inclined surface member 102. The abutment member 103 is pulled by a spring member 113 attached to the inclined surface member 102, and held in the state shown in FIG. 5B. When the cam member 112 rotates counterclockwise as seen in FIG. 5B by a power transmitted to the rotary shaft of the cam member 112, the abutment member 103 is stopped by a stopper at a position where the surface of the abutment member becomes substantially perpendicular to the traveling direction D of the recording media P (see FIG. 5A). When the cam member 112 rotates clockwise as seen in FIG. 5A, the abutment member 103 is stopped by the stopper at a position retreated (hidden) from the inclined surface guide member 110, and returns to the state shown in FIG. 5B.

Figure 6:
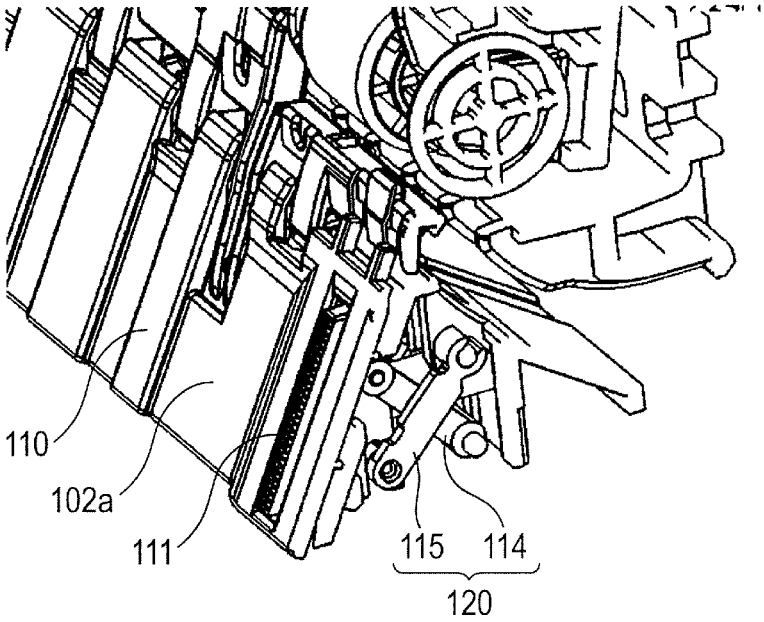
FIG. 6 is a perspective view showing a periphery of a separating member which is extracted from the sheet feeding device shown in FIG. 2.
Figure 7:
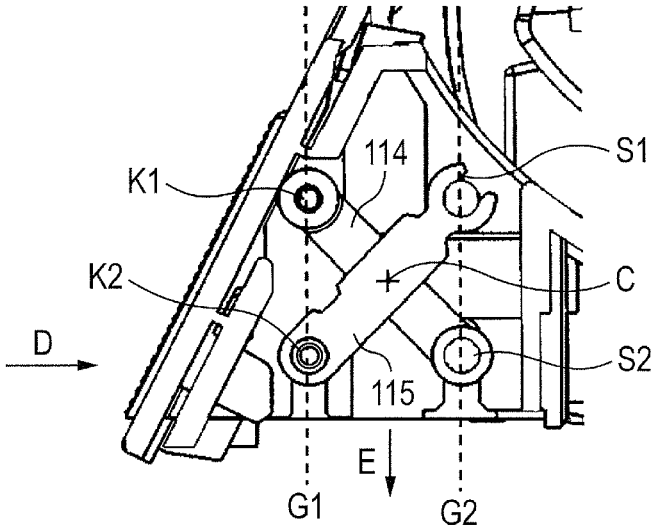
FIG. 7 is a sectional view of the separating member shown in FIG. 6.
Figure 8A:
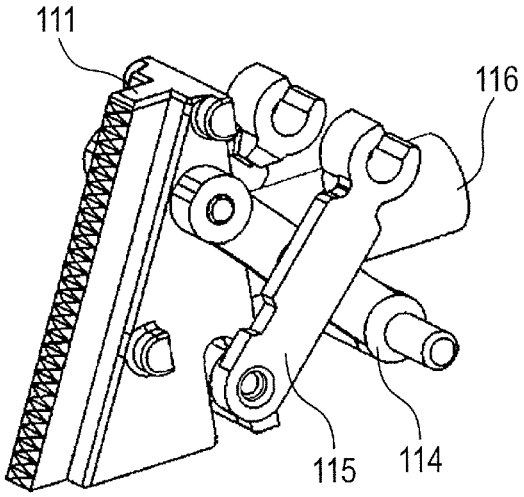
FIGS. 8A and 8B are views showing a constitution of the separating member shown in FIG. 6 in more detail.
Figure 8B:
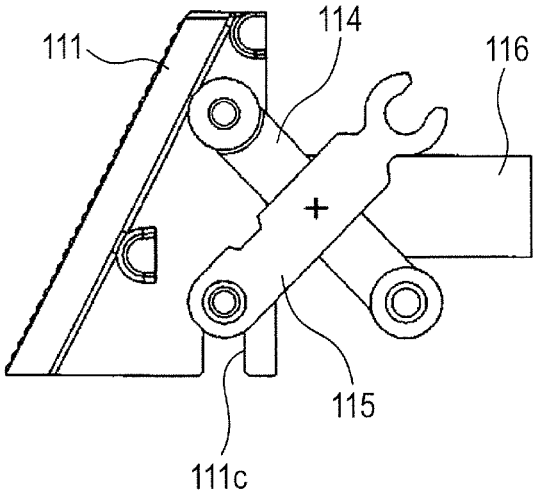
Figure 9A:
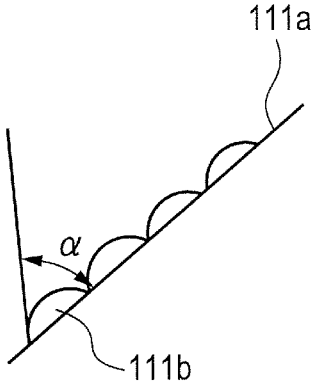
FIGS. 9A and 9B are diagrams showing an inclining angle of each projection formed on the surface of the separating member and an inclining angle of the inclined surface member.
Figure 9B:
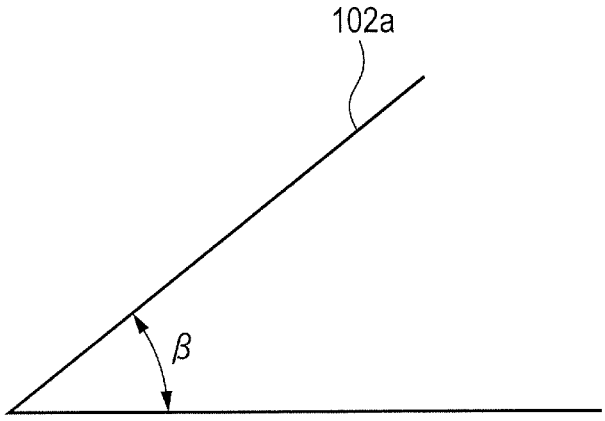

Next, the separating member 111 will be described. FIG. 6 is a perspective view showing a periphery of the separating member 111 which is extracted from the sheet feeding device 11 shown in FIG. 2. FIG. 7 is a sectional view of the separating member 111 shown in FIG. 6. FIGS. 8A and 8B show the constitution of the separating member 111 shown in FIGS. 6 and 7 in more detail. FIG. 8A is a perspective view showing the separating member 111 extracted from FIG. 6. FIG. 8B is a sectional view of the separating member 111 shown in FIG. 8A. The separating member 111 has a surface 111*a* which abuts on the recording media P, and is substantially parallel to the inclined surface 102*a* of the inclined surface member 102 (see FIG. 9A). On the surface 111*a*, a plurality of projections 111*b* are arranged along an inclining direction of the surface 111*a*. An inclining angle $\alpha$ of each of the projections 111*b* to the surface 111*a* (see FIG. 9A) is larger than an inclining angle $\beta$ of the inclined surface 102*a* of the inclined surface member 102 (see FIG. 9B). Tips of the respective projections 111*b* are rounded as shown in FIG. 9A. The separating member 111 is supported by a link mechanism 120 from an opposite side of the surface 111*a*. The link mechanism 120 has a constitution where the separating member 111 can be moved from a projecting position to a retreated position. At the projecting position, the projections 111*b* project to the inclined surface 102*a* of the inclined surface member 102 to abut on the recording medium of the uppermost layer during the conveyance. At the retreated position, the projections 111*b* retreat (hide) from the inclined surface 102*a* of the inclined surface member 102.

Hereinafter, a constitution of the link mechanism 120 will be described.

In the present embodiment, the link mechanism 120 includes a pair of link members 114 and 115. The link members 114 and 115 are linked to cross each other at center C. One end of the link member 114 (one link member) is rotatably attached to the separating member 111 via a fitting hole K1. In the separating member 111, one end of the link member 115 (the other link member) is attached to a position which is lower than the one end of the link member 114. A fitting hole is formed in the one end of the link member 115, and this fitting hole engages with a slide shaft K2 along a long hole 111*c* formed in the separating member 111 in a direction crossing the traveling direction D. In the present embodiment, a straight line G1 (see FIG. 7) connecting the one end of the link member 114 to the one end of the link member 115 becomes substantially perpendicular to the traveling direction D. Therefore, in the present embodiment, the slide shaft K2 is slidable in a direction which is perpendicular to the traveling direction D (see an arrow E of FIG. 7).

In the other end of the link member 114, a fitting hole is formed. This fitting hole engages with a slide shaft S2 which slides in the same direction as the one end of the link member 115. In the inclined surface member 102, the other end of the link member 115 is rotatably attached to a position which is higher than the other end of the link member 114 via a fitting hole S1. In the present embodiment, a straight line G2 connecting the other end of the link member 114 to the other end of the link member 115 becomes substantially perpendicular to the traveling direction D. Therefore, the slide shaft S2 is slidable in the direction of the arrow E shown in FIG. 7, similarly to the slide shaft K2. In the present embodiment, a distance from each end of the link member 114 to the center C is equal to a distance from each end of the link member 115 to the center C. That is, the distance from the fitting hole K1 to the center C is equal to the distance from the slide shaft K2 to the center C, and the distance from the fitting hole S1 to the center C is equal to the distance from the slide shaft S2 to the center C (see FIG. 7). According to the above constitution, the inclined surface of the separating member 111 moves while maintaining the inclining angle of the inclined surface member 102.

On an opposite side of the surface 111*a* of the separating member 111, a spring member 116 is attached. The spring member 116 presses the separating member 111, to hold the separating member 111 at the above projecting position. A pressing force of the spring member 116 acts in a direction opposite to an abutment force of each recording medium P (this abutment force is set by means of a rigidity of the recording medium in a distance from a contact portion of the sheet feeding roller 106 which has fed the recording medium and the front edge of the recording medium which abuts on the separating member 111, or the rigidity of the recording medium itself). The rigidity of the recording medium for use and an acting force of the spring member 116 are suitably regulated.

In the sheet feeding device 11, when the abutment force received by the separating member 111 at the projecting position during the abutment of the recording medium P is larger than the pressing force of the spring member 116, the slide shaft S2 and the slide shaft K2 simultaneously slide in the direction of the arrow E (see FIG. 7). In consequence, the link members 114 and 115 are deformed so that the one end of the link member 114 is away from the other end of the link member 115 and the one end of the member 115 and so that the other end of the link member 114 and the link member 115 are away from each other. Due to the deformation, the separating member 111 moves toward the above retreated position to hide in the inclined surface member 102. This moving operation of the separating member 111 is similarly performed regardless of a height of the stacked recording media P in the sheet feeding tray 101.

Figure 10:
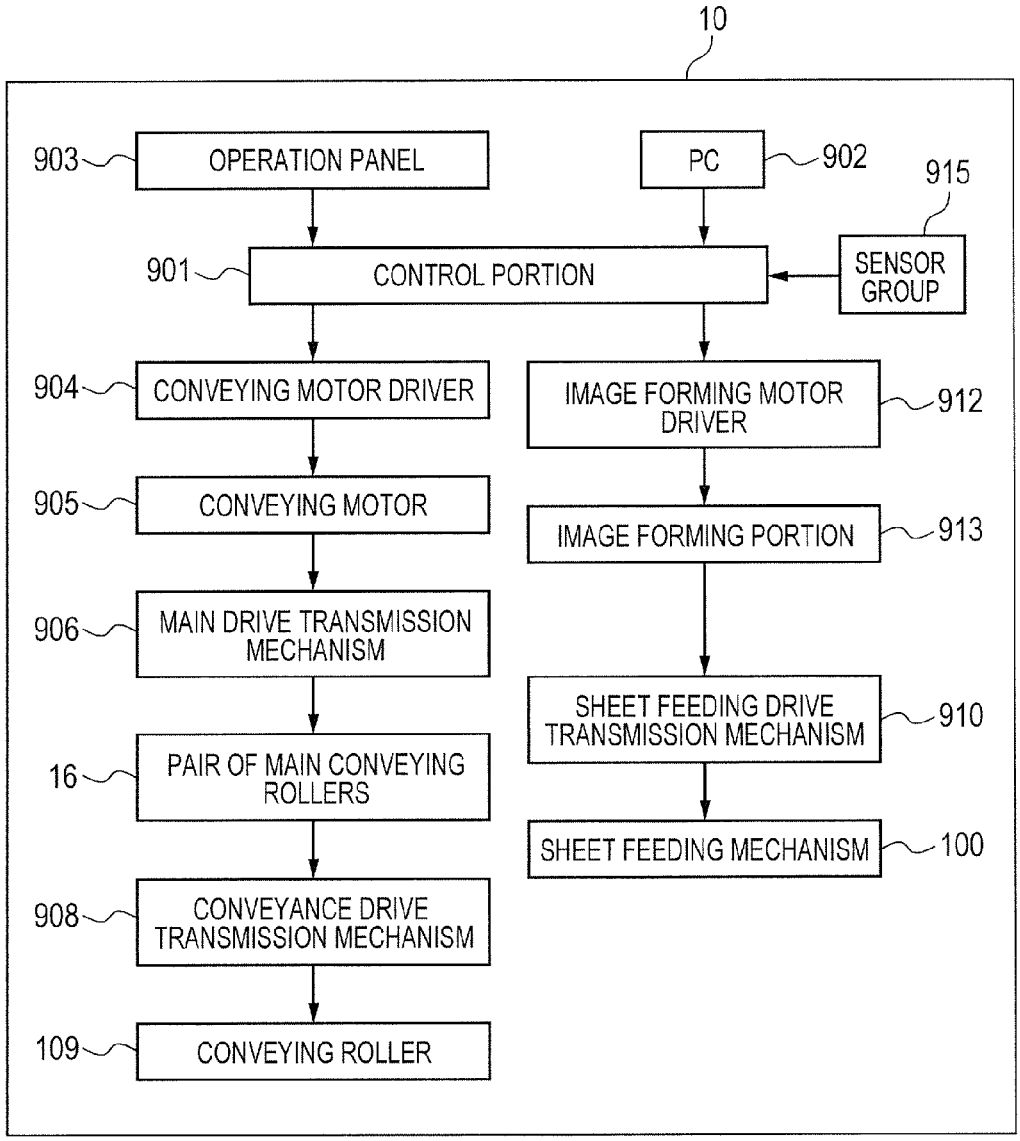
FIG. 10 is a block diagram showing an electric control constitution of the ink jet recording apparatus of Embodiment 1.

FIG. 10 is a block diagram showing an electric control constitution of the ink jet recording apparatus 10 shown in FIG. 1. A control portion 901 is connected to a personal computer (PC) 902 which sends a signal to the control portion 901, or an operation panel 903 disposed in an apparatus main body. The control portion 901 starts an image forming operation, when a predetermined signal is input from the PC 902 or the operation panel 903, or when a predetermined measuring time of a timer in the control portion 901 elapses. The control portion 901 issues an instruction to a motor driver 904 so as to supply a power to a conveying motor 905. The conveying motor 905 is connected to a main drive transmission mechanism 906. The conveying motor 905 drives the pair of main conveying rollers 16 via the main drive transmission mechanism 906. The pair of main conveying rollers 16 are connected to a conveyance drive transmission mechanism 908. When the pair of main conveying rollers 16 are driven, the conveyance drive transmission mechanism 908 drives the conveying roller 109.

Moreover, the control portion 901 issues an instruction to an image forming motor driver 912 so as to supply the power to an image forming portion motor 913. The image forming portion motor 913 is connected to an image forming portion 914. The image forming portion 914 and the conveyance drive transmission mechanism 908 are connected to a sheet feeding drive transmission mechanism 910. The sheet feeding drive transmission mechanism 910 selectively switches the transmission of the power from the conveyance drive transmission mechanism 908 to the sheet feeding mechanism 100 and the non-transmission of the power, in accordance with the position of the carriage 18 of the image forming portion 914. In consequence, it is possible to perform synchronous drive/asynchronous drive of the sheet feeding mechanism 100 and the conveying roller 109.

The rotating states and load states of the above motors and the conveyance state of the recording media P are detected by sensors constituting a sensor group 915 disposed in portions of the ink jet recording apparatus 10. Detection information of the sensor group 915 is sent to the control portion 901. The control portion 901 controls the respective motors on the basis of the signal input from the PC 902 or the operation panel 903 and the detection information input from the sensor group 915.

Figure 11:
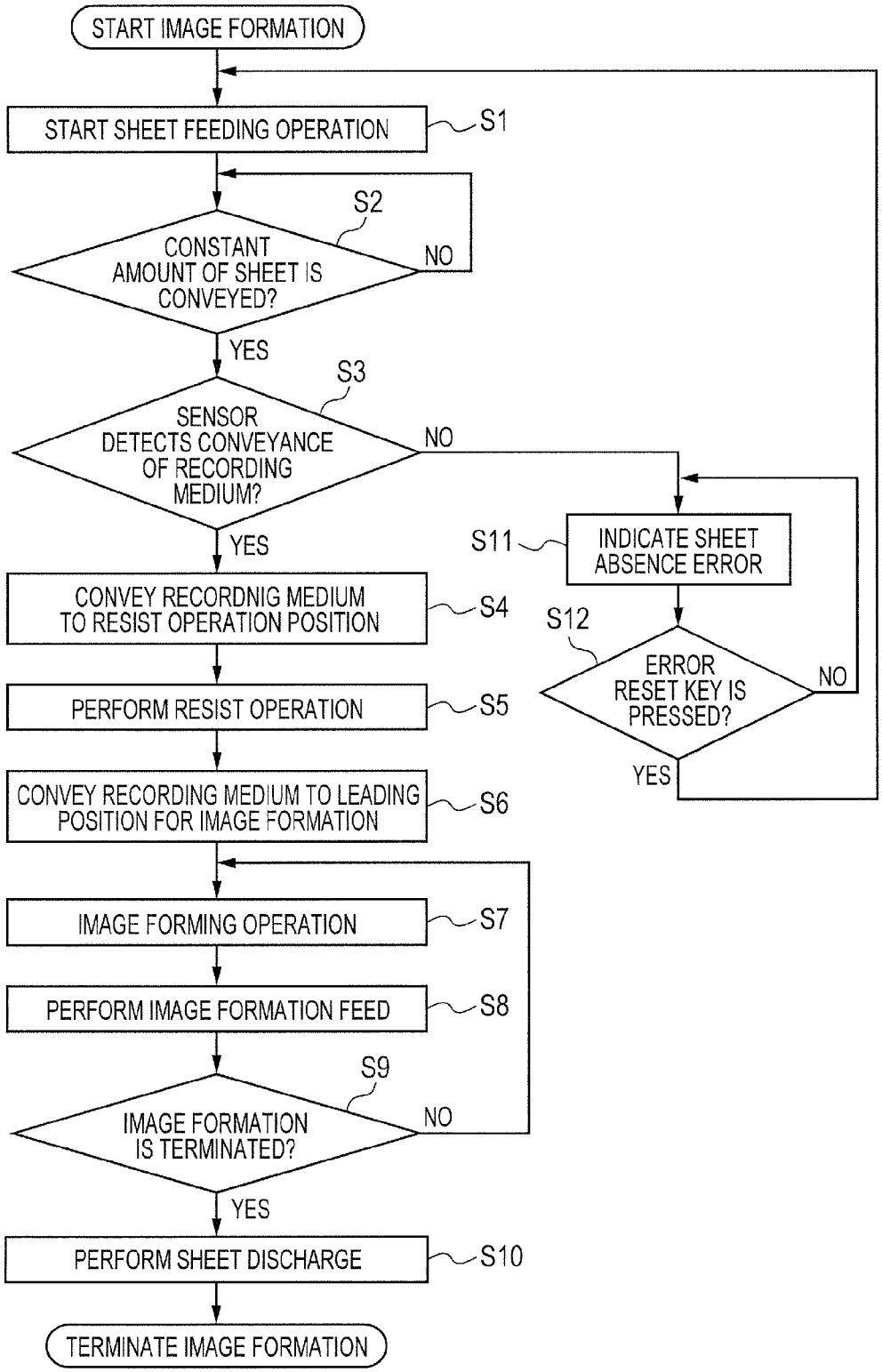
FIG. 11 is a flowchart showing an operation procedure of the ink jet recording apparatus of Embodiment 1.

FIG. 11 is a flowchart showing an operation procedure of the ink jet recording apparatus of the present embodiment. When a signal indicating that image formation is started is input into the control portion 901 from the PC 902, a sheet feeding operation is started (step S1). Specifically, the control portion 901 sends the above instruction to the motor driver 904 to drive the conveying motor 905, and successively rotates the sheet feeding roller 106 and the conveying roller 109.

After the start of the sheet feeding operation, the control portion 901 judges whether or not an amount of the recording media P to be conveyed reaches a constant amount (step S2). The constant amount is the minimum amount required for conveying the front edge of each recording medium P to the pair of main conveying rollers 16. Then, the control portion 901 judges whether or not one sensor (not shown) of the sensor group 915 detects that the recording medium P reaches the pair of main conveying rollers 16, before a predetermined time elapses (step S3). When the reaching of the recording medium P is not detected, the control portion 901 allows the operation panel 903 to display a sheet feeding error (step S11), thereby prompting a user to feed the recording medium P again. When the control portion 901 accepts the sheet re-feeding through an error cancel key disposed in the operation panel 903 (step S12), the control portion returns to the operation of the step S1.

In the step S3, when the sensor detects that the front edge of the recording medium P nearly reaches the pair of main conveying rollers 16, the control portion 901 performs a resist operation (steps S4 and 5). The resist operation mentioned herein is an operation of correcting the direction of the recording medium P so that one side of the front edge of the recording medium P crosses the conveying direction of the recording medium P at right angles. After performing the resist operation, the control portion 901 allows the pair of main conveying rollers 16 and the image forming portion 914 to perform the image forming operation (step S6 to step S8). On terminating the image forming operation (step S9), the control portion 901 performs a discharge operation to discharge the recording medium P (step S10).

According to the present embodiment, when the recording medium P has characteristics that the rigidity is low (double-sheets feeding easily occurs) and that the recording surface is not easily damaged, the separating member 111 is held at the projecting position. Therefore, the projections 111*b* can enhance a separating performance. In contrast, when the recording medium P has characteristics that the rigidity is high and that the recording surface is easily damaged, the separating member 111 moves from the projecting position to the retreated position in accordance with the rigidity. Therefore, the recording surface of the recording medium P does not come in contact with the projections 111*b*, and hence the damages on the recording surface can be decreased, when the recording medium P passes through the inclined surface member 102. Furthermore, the separating member 111 can stably perform the separating operation, even when the amount of the stacked recording media P is large or small. Therefore, a plurality of recording media stacked on one another can suitably be separated one by one in accordance with the type of the recording media.

Figure 12:
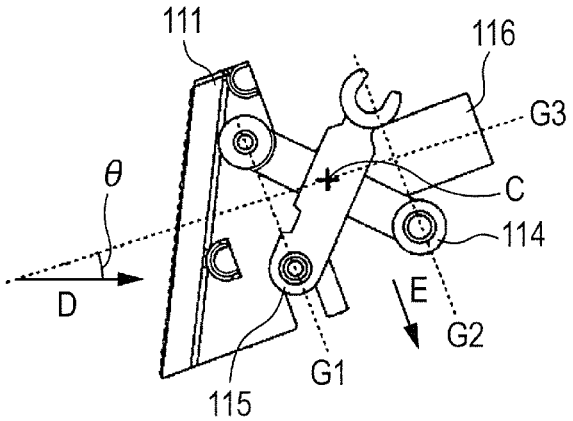
FIG. 12 is a sectional view showing another configuration of a link mechanism in the sheet feeding device of Embodiment 1.

In the present embodiment, the abutment force received by the separating member 111 is efficiently transmitted to the link mechanism 120, and hence the above straight lines G1 and G2 are perpendicular to the traveling direction D in the constitution. However, the present invention is not limited to this constitution. For example, as shown in FIG. 12, a straight line G3 which is perpendicular to the straight lines G1 and G2 may form an angle θ upwardly to the traveling direction D. In this case, when the abutment force becomes larger than the pressing force of the spring member 116, the slide shaft K2 and the slide shaft S2 slide in a direction which is parallel to the straight lines G1 and G2 (see an arrow E of FIG. 12). Consequently, the separating member 111 moves from the projecting position toward the retreated position. Additionally, a range of the angle θ is θ<θ< the inclining angle β (see FIG. 9B). When the angle θ has a negative value (when the straight line G3 inclines downwardly), the recording medium P is locally bent in a width direction, and hence a resistance during the separation becomes excessively large. Therefore, when a recording medium such as a photograph sheet having a coating layer is conveyed, a possibility that the coating layer peels off unfavorably becomes high. (The angle is not suitable not only for the recording medium having the high rigidity but also for the recording medium having the low rigidity.) When the angle θ is the inclining angle β, the separating member 111 moves along the inclined surface 102*a* of the inclined surface member 102, and hence the separating member 111 cannot be moved to the retreated position. In this case, when the recording medium P passes through the inclined surface member 102, the projections 111*b* of the separating member 111 unfavorably constantly come in contact with the recording medium P. Therefore, the angle θ is limited to the above range. Also in this constitution example, the inclined surface of the separating member 111 moves while maintaining the inclining angle of the inclined surface member 102.

Embodiment 2

A recording apparatus of the present embodiment will be described. In the recording apparatus of the present embodiment, a constitution of a link mechanism 120 is different from that in the above ink jet recording apparatus 10 of Embodiment 1. Hereinafter, the constitution of the link mechanism 120 will be described in detail.

Figure 13:
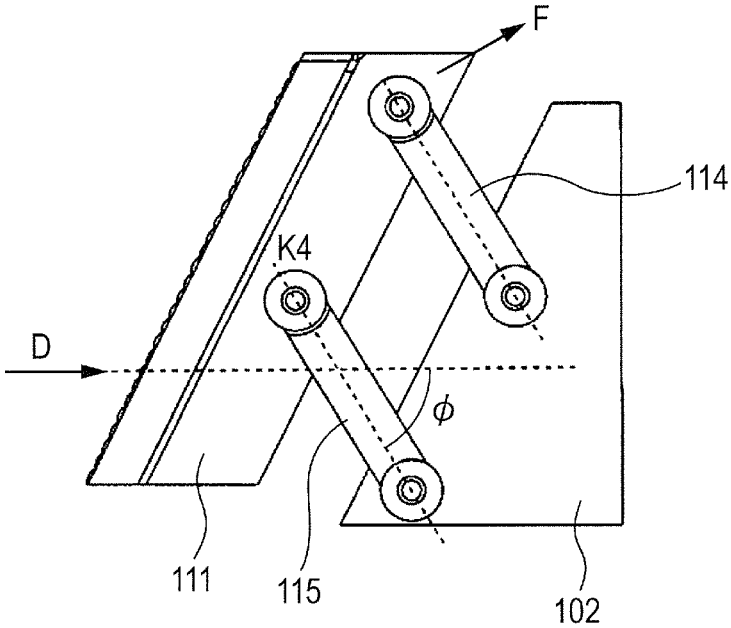
FIG. 13 is a sectional view showing a constitution of a link mechanism in an ink jet recording apparatus of Embodiment 2.

FIG. 13 is a sectional view showing the constitution of the link mechanism 120 disposed in an ink jet recording apparatus of the present embodiment. In the present embodiment, a link member 114 and a link member 115 having an equal length are arranged. One end of each of the link members 114 and 115 is attached to a separating member 111. On the other hand, the other end of each of the link members 114 and 115 is rotatably attached to an inclined surface member 102.

In the present embodiment, the link member 114 and the link member 115 support the separating member 111 at a projecting position, in an inclined state at an angle ϕ to a traveling direction D.

In a sheet feeding device 11, when an abutment force is larger than a pressing force of a spring member 116, the link members 114 and 115 rotate around the other ends thereof in a rotating direction F. In consequence, the separating member 111 moves from the projecting position toward a retreated position to hide in the inclined surface member 102. This moving operation of the separating member 111 is similarly performed regardless of a height of the stacked recording media P in a sheet feeding tray 101.

According to the present embodiment, similarly to Embodiment 1, the separating member 111 moves from the projecting position toward the retreated position in accordance with the rigidity of the recording medium P. Therefore, a plurality of recording media stacked on one another can suitably be separated one by one in accordance with the type of the recording media.

According to the present embodiment, it is not necessary to link the link member 114 and the link member 115 to each other so as to cross each other. Therefore, unlike Embodiment 1, the link mechanism 120 can be formed in a simple constitution. Furthermore, the link member 114 and the link member 115 can be formed in the same shape and size, and hence low cost can be realized. In the present embodiment, two link members are used, but there are not any special restrictions on the number of the link members as long as a plurality of link members are used.

Additionally, also in this constitution example, the inclined surface of the separating member 111 moves while maintaining the inclining angle of the inclined surface member 102.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-178796, filed Aug. 18, 2011, which is hereby incorporated by reference herein in its entirety.

What is claimed is:

1. A sheet feeding device which feeds a plurality of stacked sheets one by one, comprising:

a sheet feeding roller which comes in contact with an uppermost sheet of the stacked sheets, and rotates to feed the uppermost sheet;

an inclined member including an inclined surface which is positioned downstream of the stacked sheets in a feeding direction of the sheets, and against which the fed sheet abuts;

a separating member configured to separate the sheet fed by sheet feeding roller;

a plurality of link members, one end portion of each link member attached to the separating member and another end portion attached to a body of the sheet feeding device so that the separating member is movable between a projecting position projecting from the inclined surface and a retracted position retracted from the projecting position; and an elastic member configured to press the separating member toward the projecting position, wherein the separating member is moved toward the retracted position according to force received from the sheet fed by the sheet feeding roller.

2. The sheet feeding device according to claim 1, wherein the separating member is positioned between the projecting position and the retracted position, in accordance with a relation between an elastic force of the elastic member and the force received from the sheet fed by the sheet feeding roller.

3. The sheet feeding device according to claim 2, wherein the separating member is moved toward the retracted position according to a rigidity of the sheet which abuts against the separating member.

4. A recording apparatus comprising:

the sheet feeding device according to claim 1; and a recording head which records an image on a sheet fed from the sheet feeding device.

5. A sheet feeding device comprising:

a sheet feeding roller configured to advance an uppermost sheet of a stack of sheets;

an inclined surface disposed downstream of the stacked sheets in an advancing direction of the sheet;

a separating member configured to separate one sheet fed by the feeding roller;

a plurality of link members, one end portion of each link member attached to the separating member and another end portion attached to a body of the sheet feeding device so that the separating member is movable between a projecting position projecting from the inclined surface and a retracted position retracted from the projecting position; and an elastic member configured to press the separating member toward the projecting position, wherein the separating member is moved toward the retracted position according to a force received from the sheet fed by the sheet feeding roller in accordance with an abutment force of the sheet received by the surface of the separating member at the projecting position during the abutment of the sheet.

6. The sheet feeding device according to claim 5, wherein the elastic member includes a spring member which presses the separating member from an opposite side of the surface in a direction opposite to a traveling direction of the sheet, to hold the separating member at the projecting position, and wherein the separating member moves from the projecting position toward the retracted position when the abutment force becomes larger than the pressing force of the spring member.

7. The sheet feeding device according to claim 6, wherein:

the plurality of link members include a pair of crossing link members linked to cross each other at the center, a first of the crossing link members has one end portion rotatably attached to the separating member, and another end portion slidably attached to the inclined surface member in a direction crossing the traveling direction, a second of the pair of crossing link members has one end portion attached to the separating member at a position which is lower than the one end portion of the first link member so as to be slidable in the same direction as the another end portion of the first of the pair of crossing link members and has another end portion of the second of the crossing link members rotatably attached to a position on the inclined surface which is higher than the another end portion of the first of the pair of crossing link members, and the another end portion of the first of the pair of crossing link members and the one end portion of the second of the pair of crossing link members slide when the abutment force becomes larger than the pressing force.

8. The sheet feeding device according to claim 7, wherein a straight line connecting the one end of the first of the pair of crossing link members to the one end of the second of the pair of crossing link members and a straight line connecting the another end of the first of the pair of crossing link members to the another end of the second of the pair of crossing link members are perpendicular to the traveling direction.

9. The sheet feeding device according to claim 6, wherein the plurality of link members are parallel to one another, one end portion of each of the link members is attached to the separating member, the another end portion of the link member is rotatably attached to the inclined surface member, and the link member rotates around the another end portion when the abutment force becomes larger than the pressing force.

10. The sheet feeding device according to claim 5, wherein the separation member has projections contacted by sheet fed by the feeding roller, and tips of the projections are rounded.

11. The sheet feeding device according to claim 10, wherein and inclining angle of each of the projections to the inclined surface is larger than an inclining angle of the inclined surface.

12. The sheet feeding device according to claim 5, wherein the inclined surface member further includes an abutment member attached so as to be movable between a position where the abutment member abuts on front edges of the plurality of sheets and a position where the abutment member is away from the front edges.

* * * * *